US005708980A

United States Patent [19]

LaManna et al.

[11] Patent Number: 5,708,980

[45] Date of Patent: Jan. 20, 1998

[54] PROTECTIVE GLOVE

[76] Inventors: Brenda LaManna; J. Jaye Vaughn, both of 41 Stewart Ave., Tuckahoe, N.Y. 10707

[21] Appl. No.: 779,837

[22] Filed: Jan. 7, 1997

[51] Int. Cl.[6] ..... A41D 19/00

[52] U.S. Cl. ..... 2/163; 2/907

[58] Field of Search ..... 2/158, 159, 163, 2/169, 907, 161.1, 161.6, 167, 46, 61

[56] References Cited

U.S. PATENT DOCUMENTS

| | | | |
|---|---|---|---|
| 730,051 | 6/1903 | Scott | 2/907 |
| 2,760,203 | 8/1956 | De Grazia | 2/907 |
| 3,760,425 | 9/1973 | Komatsu | 2/169 |
| 4,534,066 | 8/1985 | Hansson | 2/169 |
| 4,752,973 | 6/1988 | Wolfberg et al. | 2/169 |

*Primary Examiner*—C. D. Crowder
*Assistant Examiner*—Larry D. Worrell, Jr.

[57] ABSTRACT

A new Protective Glove for covering the hands of a user and protecting hosiery and other delicate fabrics from snags and tears caused by rough skin or jagged fingernails. The glove is intended for use while putting on and taking off pantyhose and silk garments. The inventive device includes a palm piece, a back piece, a gusset panel, and a thumb stall joined together to fit a human hand, wherein the palm piece and the back piece each have a first finger section for receiving an index finger of the user and a second finger section for receiving a middle finger, a ring finger, and a little finger of the user, and wherein the gusset panel interconnects the palm piece and the back piece between and along adjacent sides of the index finger and the middle finger. The gusset panel allows for maximum mobility of the index finger of the user of the glove. The glove is fabricated of a lightweight and smooth material, such as nylon, so as to enable the user to easily guide pantyhose on and off. The glove has finger sections sufficiently large to accommodate jewelry on the fingers of the user and also has extended tips at the ends of the finger sections and the thumb stall to accommodate long fingernails of the user.

20 Claims, 3 Drawing Sheets

PROTECTIVE GLOVE

BACKGROUND OF THE INVENTION

1. Field of the Invention

The present invention relates to gloves and more particularly pertains to a new Protective Glove for covering the hands of a user and protecting hosiery and other delicate fabrics from snags and tears caused by rough skin or jagged fingernails.

2. Description of the Prior Art

The use of gloves is known in the prior art. More specifically, gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art gloves include U.S. Pat. Nos. 4,752,973; 5,016,286; 4,916,757; 4,534,066; and 4,104,740.

While these devices fulfill their respective, particular objectives and requirements, the aforementioned patents do not disclose a new Protective Glove. The inventive device includes a palm piece, a back piece, a gusset panel, and a thumb stall joined together to fit a human hand, wherein the palm piece and the back piece each have a first finger section for receiving an index finger of the user and a second finger section for receiving a middle finger, a ring finger, and a little finger of the user, and wherein the gusset panel interconnects the palm piece and the back piece between and along adjacent sides of the index finger and the middle finger.

In these respects, the Protective Glove according to the present invention substantially departs from the conventional concepts and designs of the prior art, and in so doing provides an apparatus primarily developed for the purpose of covering the hands of a user and protecting hosiery and other delicate fabrics from snags and tears caused by rough skin or jagged fingernails.

SUMMARY OF THE INVENTION

In view of the foregoing disadvantages inherent in the known types of gloves now present in the prior art, the present invention provides a new Protective Glove construction wherein the same can be utilized for covering the hands of a user and protecting hosiery and other delicate fabrics from snags and tears caused by rough skin or jagged fingernails.

The general purpose of the present invention, which will be described subsequently in greater detail, is to provide a new Protective Glove apparatus and method which has many of the advantages of the gloves mentioned heretofore and many novel features that result in a new Protective Glove which is not anticipated, rendered obvious, suggested, or even implied by any of the prior art gloves, either alone or in any combination thereof.

To attain this, the present invention generally comprises a palm piece, a back piece, a gusset panel, and a thumb stall joined together to fit a human hand, wherein the palm piece and the back piece each have a first finger section for receiving an index finger of the user and a second finger section for receiving a middle finger, a ring finger, and a little finger of the user, and wherein the gusset panel interconnects the palm piece and the back piece between and along adjacent sides of the index finger and the middle finger.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Protective Glove apparatus and method which has many of the advantages of the gloves mentioned heretofore and many novel features that result in a new Protective Glove which is not anticipated, rendered obvious, suggested, or even implied by any of the prior art gloves, either alone or in any combination thereof.

It is another object of the present invention to provide a new Protective Glove which may be easily and efficiently manufactured and marketed.

It is a further object of the present invention to provide a new Protective Glove which is of a durable and reliable construction.

An even further object of the present invention is to provide a new Protective Glove which is susceptible of a low cost of manufacture with regard to both materials and labor, and which accordingly is then susceptible of low prices of sale to the consuming public, thereby making such Protective Glove economically available to the buying public.

Still yet another object of the present invention is to provide a new Protective Glove which provides in the apparatuses and methods of the prior art some of the advantages thereof, while simultaneously overcoming some of the disadvantages normally associated therewith.

Still another object of the present invention is to provide a new Protective Glove for covering the hands of a user and protecting hosiery and other delicate fabrics from snags and tears caused by rough skin or jagged fingernails.

Yet another object of the present invention is to provide a new Protective Glove which includes a palm piece, a back piece, a gusset panel, and a thumb stall joined together to fit a human hand, wherein the palm piece and the back piece each have a first finger section for receiving an index finger of the user and a second finger section for receiving a middle finger, a ring finger, and a little finger of the user, and wherein the gusset panel interconnects the palm piece and the back piece between and along adjacent sides of the index finger and the middle finger.

Still yet another object of the present invention is to provide a new Protective Glove that is intended for use while putting on and taking off pantyhose and silk garments.

Even still another object of the present invention is to provide a new Protective Glove that is fabricated of a lightweight and smooth material so as to enable the user to easily guide pantyhose on and off.

Even still another object of the present invention is to provide a new Protective Glove that has high points at the end of the finger and thumb stalls to accommodate long fingernails of the user.

Even still another object of the present invention is to provide a new Protective Glove that has finger stalls sufficiently large to accommodate jewelry on the fingers of the user.

Even still another object of the present invention is to provide a new Protective Glove that may be used while hand washing delicate fabrics.

Even still another object of the present invention is to provide a new Protective Glove that may be used to protect fabrics against smears caused by fingernail polish.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
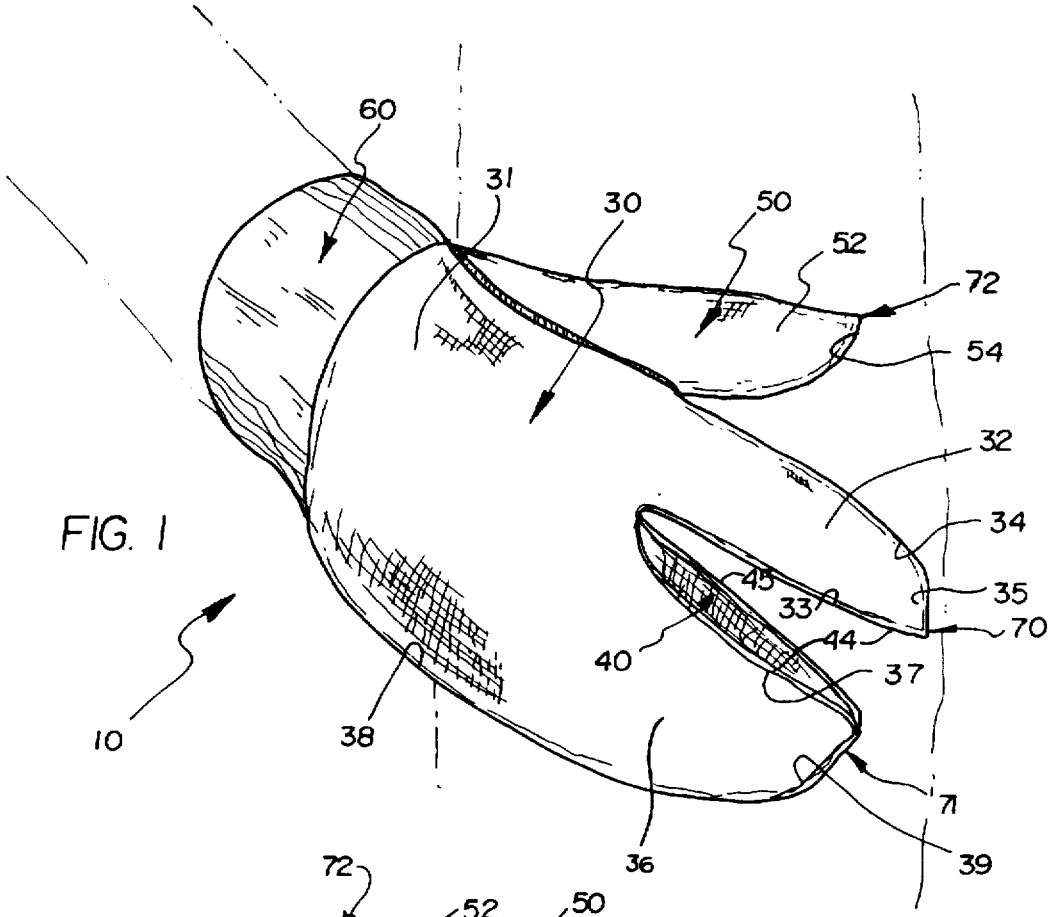
FIG. 1 is an illustration of a new Protective Glove according to the present invention.

With reference now to the drawings, and in particular to FIGS. 1 through 5 thereof, a new Protective Glove embodying the principles and concepts of the present invention and generally designated by the reference numeral 10 will be described.

More specifically, it will be noted that the Protective Glove 10 comprises a palm piece 20, a back piece 30, a gusset panel 40, and a thumb stall 50 joined together to fit a human hand, wherein the palm piece 20 and the back piece 30 each have a first finger section 22 and 32 for receiving an index finger of the user and a second finger section 26 and 36 for receiving a middle finger, a ring finger, and a little finger of the user, and wherein the gusset panel 40 interconnects the palm piece 20 and the back piece 30 between and along adjacent sides of the index finger and the middle finger.

Figure 5:
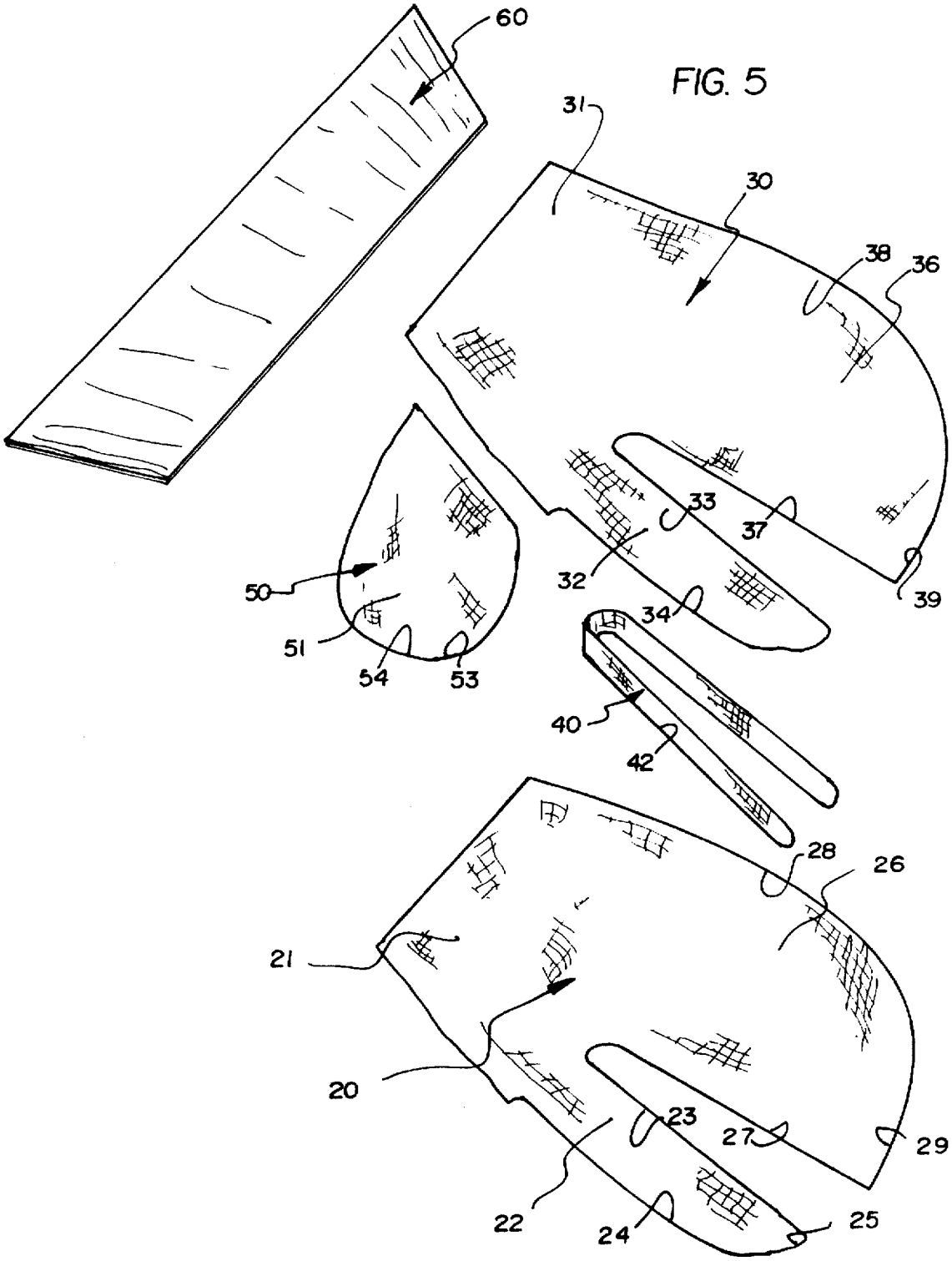
FIG. 5 is an exploded illustration of the palm piece, the back piece, the gusset panel, and the thumb stall of the present invention.

As best illustrated in FIG. 5, it can be shown that the palm piece 20 comprises a palm section 21, a first palm piece finger section 22 extending from the palm section 21 for covering the index finger of the user, and a second palm piece finger section 26 extending from the palm section 21 for covering the middle finger, the ring finger, and the little finger of the user. The first palm piece finger section 22 has an inner edge 23, an outer edge 24, and a tip end 25. The second palm piece finger section 26 has an inner edge 27, an outer edge 28, and a tip end 29.

As best illustrated in FIG. 5, it can be shown that the back piece 30 comprises a back section 31, a first back piece finger section 32 extending from the back section 31 for covering the index finger of the user, and a second back piece finger section 36 extending from the back section 31 for covering the middle finger, the ring finger, and the little finger of the user. The first back piece finger section 32 has an inner edge 33, an outer edge 34, and a tip end 35. The second back piece finger section 36 has an inner edge 37, an outer edge 38, and a tip end 39.

Figure 2:
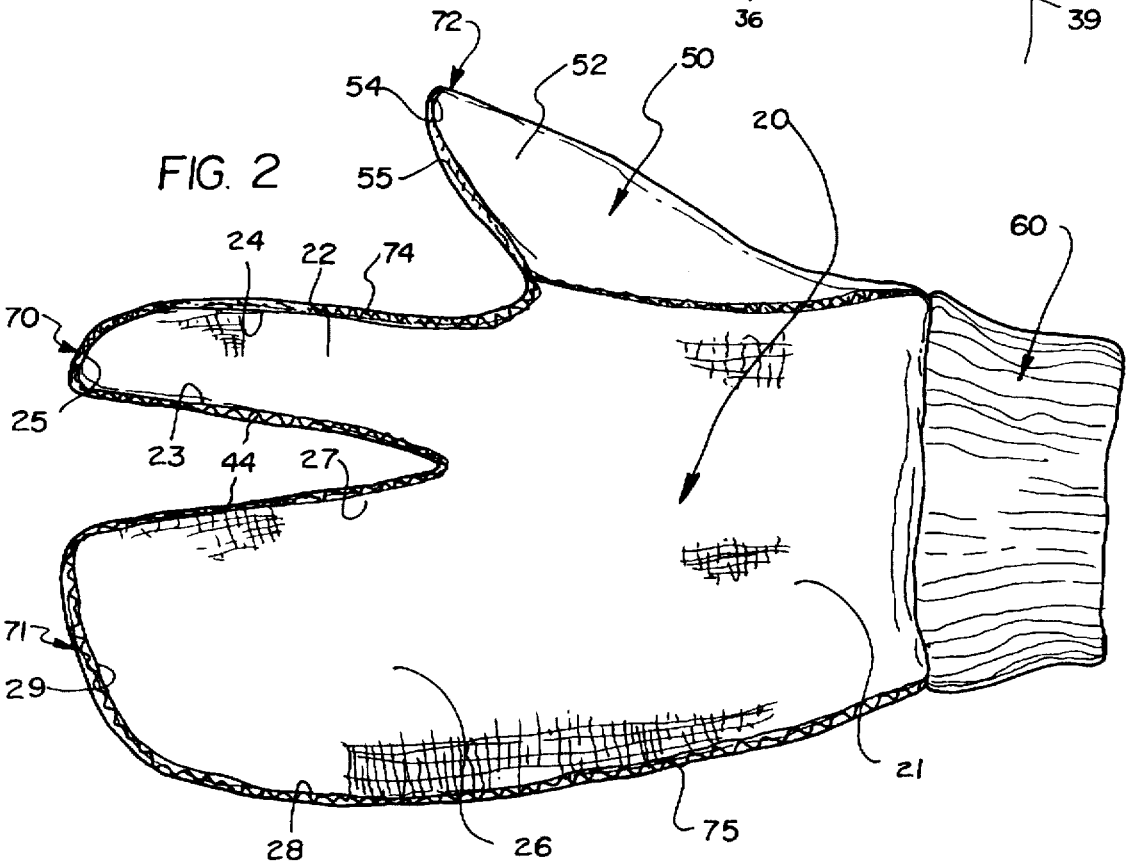
FIG. 2 is a top view of the present invention.

As best illustrated in FIGS. 1 and 2, it can be shown that the tip end 25 of the first palm piece finger section 22 and the tip end 35 of the first back piece finger section 32 are joined and form a first extended end 70 at mating edges thereof. The first extended end 70 is adapted for receiving a fingernail of the index finger of the user of the glove 10. The tip end 29 of the second palm piece finger section 26 and the tip end 39 of the second back piece finger section 36 are joined and form a second extended end 71 at mating edges thereof. The second extended end 71 is adapted for receiving a fingernail of the middle finger, a fingernail of the ring finger, and a fingernail of the little finger of the user of the glove 10.

Figure 3:
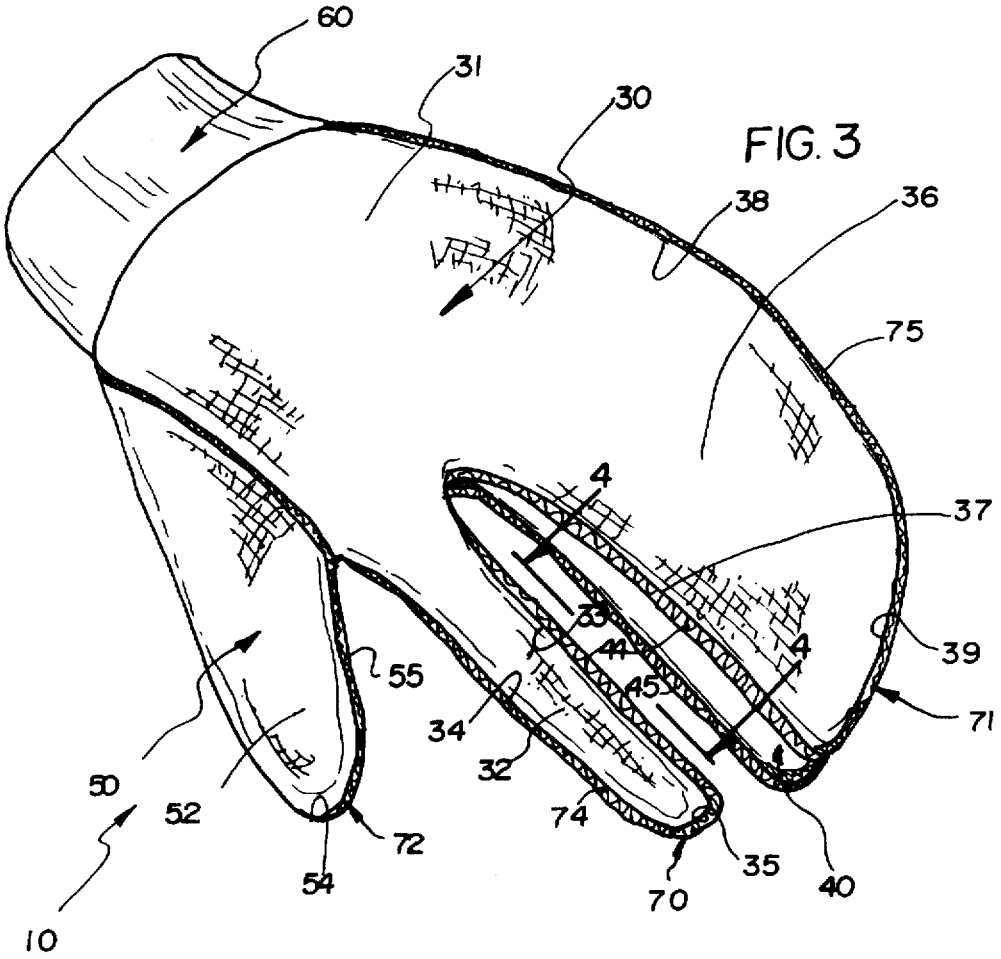
FIG. 3 is a further illustration of the present invention showing the gusset panel located along adjacent sides of the index finger and the middle finger.
Figure 4:
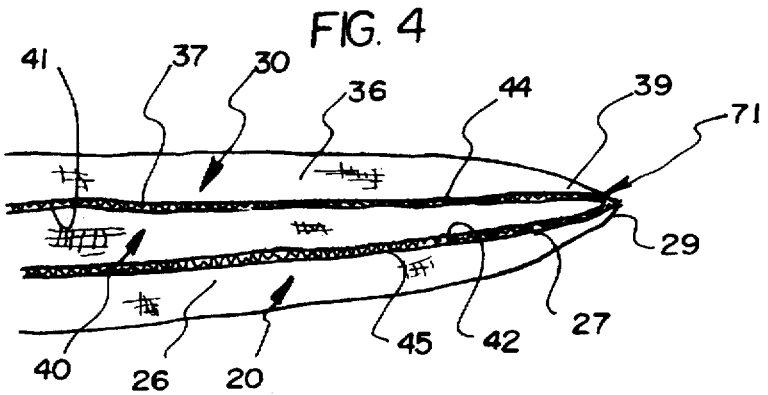
FIG. 4 is a detailed illustration of the gusset panel located along adjacent sides of the index finger and the middle finger from the perspective of line 4—4 of FIG. 3.

As best illustrated in FIGS. 3 through 5, it can be shown that the gusset panel 40 has an upper edge 41 and a lower edge 42. The gusset panel 40 is provided intermediate the palm piece 20 and the back piece 30 and interconnects the inner edge 23 of the first palm piece finger section 22 and the inner edge 33 of the first back piece finger section 32 and interconnects the inner edge 27 of the second palm piece finger section 26 and the inner edge 37 of the second back piece finger section 36. The gusset panel 40 allows for maximum mobility of the index finger of the user of the glove 10.

As best illustrated in FIGS. 3 and 4, it can be shown that the lower edge 42 of the gusset panel 40, the inner edge 23 of the first palm piece finger section 22, and the inner edge 27 of the second palm piece finger section 26 are joined and form a lower seam 45 at mating edges thereof. The upper edge 41 of the gusset panel 40, the inner edge 33 of the first back piece finger section 32, and the inner edge 37 of the second back piece finger section 36 are joined and form an upper seam 44 at mating edges thereof. The lower seam 45 and the upper seam 44 provide a means for gripping the hosiery between the index finger and the middle finger of the user of the glove 10.

As best illustrated in FIGS. 1 through 3, it can be shown that the outer edge 24 of the first palm piece finger section 22 and the outer edge 34 of the first back piece finger section 32 are joined and form a first outer edge seam 74 at mating edges thereof. The outer edge 28 of the second palm piece finger section 26 and the outer edge 38 of the second back piece finger section 36 are joined and form a second outer edge seam 75 at mating edges thereof.

As best illustrated in FIGS. 1 through 3, it can be shown that the thumb stall 50 extends from the palm section 21 of the palm piece 20 and the back section 31 of the back piece 30 in diverging relationship with the first palm piece finger section 22 and the first back piece finger section 32. As further illustrated in FIG. 5, it can be shown that the thumb stall 50 comprises a single piece 51 wherein the single piece 51 is folded to form two superimposed sections 52 and thereby surround the thumb of the user thereof. Each of the two superimposed sections 52 has a tip end 53 and 54. The two superimposed sections 52 and the tip ends 53 and 54 are joined and form a thumb stall seam 55 and a thumb extended end 72, respectively, at mating edges thereof. The thumb stall seam 55 is provided adjacent the first outer edge seam 74 of the first palm piece finger section 22 and the first back piece finger section 32. The thumb stall seam 55 and the first outer edge seam 74 provide a means for gripping the hosiery between the index finger and the thumb of the user of the glove. The thumb stall seam 55 and the lower seam 45 created by the gusset panel 40, the first palm piece finger section 22, and the second palm piece finger section 26 provide a means for gripping the hosiery between the middle finger and the thumb of the user of the glove. The thumb extended end 72 is adapted for receiving a thumbnail of the thumb of the user of the glove 10.

As best illustrated in FIGS. 1 through 2, it can be shown that the glove 10 further comprises a wrist piece 60 attached to and extending from the palm section 21 of the palm piece 20 and the back section 31 of the back piece 30. The wrist piece 60 envelops the wrist of the user of the glove 10 and secures the glove 10 on the hand of the user.

The palm piece 20, the back piece 30, the gusset panel 40, and the thumb stall 50 are fabricated from a nylon material. The nylon material has a denier of about 15. The wrist piece 60 is fabricated from a blended cotton and nylon material that allows the wrist piece 60 to be stretched. The palm piece 20, the back piece 30, the gusset panel 40, the thumb stall 50, and the wrist piece 60 are joined together with a nylon or polyester thread by a surging process whereby the palm piece 20, the back piece 30, the gusset panel 40, and the thumb stall 50 are cut and sown together in a single step thereby providing seams free of rough edges.

In use, a wearer of the glove 10 inserts his or her thumb in the thumb stall 50, inserts his or her index finger in the first finger sections 22 and 32, and inserts his or her middle finger, ring finger, and little finger in the second finger sections 26 and 36. The first extended end 70, the second extended end 71, and the thumb extended end 72 accommodate the fingernails of the wearer of the glove 10. While wearing the glove 10 a user may easily grasp and put on and take off pantyhose, silk garments, and other delicate fabrics without causing snags and tears with rough skin or jagged fingernails.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A Protective Glove for covering a hand of a user and protecting hosiery and other delicate fabrics from snags and tears caused by rough skin or jagged fingernails, comprising:

a palm piece, said palm piece comprising a palm section, a first palm piece finger section extending from said palm section for covering an index finger of said user, and a second palm piece finger section extending from said palm section for covering a middle finger, a ring finger, and a little finger of said user;

a back piece, said back piece comprising a back section, a first back piece finger section extending from said back section for covering said index finger of said user, and a second back piece finger section extending from said back section for covering said middle finger, said ring finger, and said little finger of said user, said first palm piece finger section, said second palm piece finger section, said first back piece finger section, and said second back piece finger section each having an inner edge, an outer edge, and a tip end;

a gusset panel interconnecting said palm piece and said back piece between and along adjacent sides of said index finger and said middle finger, said gusset panel having an upper edge and a lower edge; and a thumb stall extending from said palm section of said palm piece and said back section of said back piece, said thumb stall extending in diverging relationship with said first palm piece finger section and said first back piece finger section, said thumb stall having an inner edge adjacent said first palm piece finger section and said first back piece finger section, said palm piece, said back piece, said gusset panel, and said thumb stall joined together to fit said hand, wherein said lower edge of said gusset panel, said inner edge of said first palm piece finger section, and said inner edge of said second palm piece finger section are joined and form a lower seam along mating edges thereof, wherein said upper edge of said gusset panel, said inner edge of said first back piece finger section, and said inner edge of said second back piece finger section are joined and form an upper seam along mating edges thereof, wherein said outer edge of said first palm piece finger section and said outer edge of said first back piece finger section are joined and form a first outer edge seam along mating edges thereof, and wherein said thumb stall includes a thumb stall seam along said inner edge thereof, whereby said lower seam and said upper seam each provide a means for gripping said hosiery between said index finger and said middle finger of said user of said glove, whereby said thumb stall seam and said first outer edge seam provide a means for gripping said hosiery between said index finger and said thumb of said user of said glove, and whereby said thumb stall seam and said lower seam provide a means for gripping said hosiery between said middle finger and said thumb of said user of said glove.

2. The Protective Glove of claim 1, wherein said tip end of said first palm piece finger section and said tip end of said first back piece finger section are joined and form a first extended end at mating edges thereof, said first extended end adapted for receiving a fingernail of said index finger of said user of said glove.

3. The Protective Glove of claim 1, wherein said tip end of said second palm piece finger section and said tip end of said second back piece finger section are joined and form a second extended end at mating edges thereof, said second extended end adapted for receiving a fingernail of said middle finger, a fingernail of said ring finger, and a fingernail of said little finger of said user of said glove.

4. A Protective Glove for covering a hand of a user and protecting hosiery and other delicate fabrics from snags and tears caused by rough skin or jagged fingernails, comprising:

a palm piece including a palm section, a first palm piece finger section extending from said palm section for covering an index finger of said user, and a second palm piece finger section extending from said palm section for covering a middle finger, a ring finger, and a little finger of said user;

a back piece including a back section, a first back piece finger section extending from said back section for covering said index finger of said user, and a second back piece finger section extending from said back section for covering said middle finger, said ring finger, and said little finger of said user, said first palm piece finger section, said second palm piece finger section, said first back piece finger section, and said second back piece finger section each having an inner edge, an outer edge, and a tip end;

a gusset panel interconnecting said inner edge of said first palm piece finger section and said inner edge of said first back piece finger section, and interconnecting said inner edge of said second palm piece finger section and said inner edge of said second back piece finger section, said gusset panel having an upper edge and a lower edge; and a thumb stall extending from said palm section of said palm piece and said back section of said back piece in a diverging relationship with said first palm piece finger section and said first back piece finger section, said palm piece, said back piece, said gusset panel, and said thumb stall cooperatively joined to fit said hand of said user, wherein said lower edge of said gusset panel, said inner edge of said first palm piece finger section, and said inner edge of said second palm piece finger section are joined and form a lower seam along mating edges thereof, and wherein said upper edge of said gusset panel, said inner edge of said first back piece finger section, and said inner edge of said second back piece finger section are joined and form an upper seam along mating edges thereof, said lower seam and said upper seam providing a means for gripping said hosiery between said index finger and said middle finger of said user of said glove, wherein said outer edge of said first palm piece finger section and said outer edge of said first back piece finger section are joined and form a first outer edge seam along mating edges thereof, and wherein said thumb stall comprises a single piece, said single piece being folded to form two superimposed sections and thereby surround said thumb of said user of said glove, wherein said two superimposed sections are joined and form a thumb stall seam along mating edges thereof, said thumb stall seam provided adjacent said first outer edge seam, said thumb stall seam and said first outer edge seam providing a means for gripping said hosiery between said index finger and said thumb of said user of said glove, said thumb stall seam and said lower seam providing a means for gripping said hosiery between said middle finger and said thumb of said user of said glove.

5. The Protective Glove of claim 4, wherein each of said two superimposed sections of said thumb stall has a tip end, said tip ends joined and forming a thumb extended end at mating edges thereof, said thumb extended end adapted for receiving a thumbnail of said thumb of said user of said glove.

6. The Protective Glove of claim 1, wherein said palm piece, said back piece, said gusset panel, and said thumb stall are fabricated from a nylon material.

7. The Protective Glove of claim 6, wherein said nylon material has a denier of about 15.

8. The Protective Glove of claim 1, further comprising a wrist piece attached to and extending from said palm section of said palm piece and said back section of said back piece, said wrist piece enveloping a wrist of said user of said glove and securing said glove on said hand of said user.

9. The Protective Glove of claim 8, wherein said wrist piece is fabricated from a blended cotton and nylon material.

10. The Protective Glove of claim 1, wherein said thumb stall has a thumb extended end, said thumb extended end adapted for receiving a thumbnail of said thumb of said user of said glove.

11. The Protective Glove of claim 4, wherein said tip end of said first palm piece finger section and said tip end of said first back piece finger section are joined and form a first extended end at mating edges thereof, said first extended end adapted for receiving a fingernail of said index finger of said user of said glove.

12. The Protective Glove of claim 4, wherein said tip end of said second palm piece finger section and said tip end of said second back piece finger section are joined and form a second extended end at mating edges thereof, said second extended end adapted for receiving a fingernail of said middle finger, a fingernail of said ring finger, and a fingernail of said little finger of said user of said glove.

13. The Protective Glove of claim 4, wherein said palm piece, said back piece, said gusset panel, and said thumb stall are fabricated from a nylon material.

14. The Protective Glove of claim 13, wherein said nylon material has a denier of about 15.

15. The Protective Glove of claim 4, further comprising a wrist piece attached to and extending from said palm section of said palm piece and said back section of said back piece, said wrist piece enveloping a wrist of said user of said glove and securing said glove on said hand of said user.

16. The Protective Glove of claim 15, wherein said wrist piece is fabricated from a blended cotton and nylon material.

17. A Protective Glove for covering a hand of a user and protecting hosiery and other delicate fabrics from snags and tears caused by rough skin or jagged fingernails, comprising:

a palm piece including a palm section, a first palm piece finger section extending from said palm section for covering an index finger of said user, and a second palm piece finger section extending from said palm section for covering a middle finger, a ring finger, and a little finger of said user;

a back piece including a back section, a first back piece finger section extending from said back section for covering said index finger of said user, and a second back piece finger section extending from said back section for covering said middle finger, said ring finger, and said little finger of said user;

a gusset panel interconnecting said palm piece and said back piece between and along adjacent sides of said index finger and said middle finger; and a thumb stall extending from said palm section of said palm piece and said back section of said back piece in a diverging relationship with said first palm piece finger section and said first back piece finger section, said thumb stall comprising a single piece folded to form two superimposed sections for surrounding said thumb of said user of said glove, said palm piece, said back piece, said gusset panel, and said thumb stall cooperatively joined to fit said hand of said user.

18. The Protective Glove of claim 17, wherein said first palm piece finger section, said second palm piece finger section, said first back piece finger section, and said second back piece finger section each have an inner edge and an outer edge, and wherein said gusset panel has an upper edge and a lower edge, wherein said outer edge of said first palm piece finger section and said outer edge of said first back piece finger section are joined and form a first outer edge seam along mating edges thereof, and wherein said two superimposed sections of said thumb stall are joined and form a thumb stall seam along mating edges thereof, said thumb stall seam provided adjacent said first outer edge seam, whereby said thumb stall seam and said first outer edge seam provide a means for gripping said hosiery between said index finger and said thumb of said user of said glove.

19. The Protective Glove of claim 18, wherein said lower edge of said gusset panel, said inner edge of said first palm piece finger section, and said inner edge of said second palm piece finger section are joined and form a lower seam along mating edges thereof, whereby said thumb stall seam and said lower seam provide a means for gripping said hosiery between said middle finger and said thumb of said user of said glove.

20. The Protective Glove of claim 19, wherein said upper edge of said gusset panel, said inner edge of said first back piece finger section, and said inner edge of said second back piece finger section are joined and form an upper seam along mating edges thereof, whereby said lower seam and said upper seam provide a means for gripping said hosiery between said index finger and said middle finger of said user of said glove.

* * * * *